United States Patent [19]

Fry et al.

[11] 4,326,839

[45] Apr. 27, 1982

[54] CYLINDER UNLOADING MECHANISM FOR REFRIGERATION COMPRESSOR

[75] Inventors: Emanuel D. Fry, Tecumseh, Mich.; Herbert G. Siewert, Sylvania, Ohio

[73] Assignee: Tecumseh Products Company, Tecumseh, Mich.

[21] Appl. No.: 101,228

[22] Filed: Dec. 6, 1979

[51] Int. Cl.[3] ..... F04B 49/00

[52] U.S. Cl. ..... 417/295; 417/507

[58] Field of Search ..... 417/295, 559, 564, 312, 417/313, 507

[56] References Cited

U.S. PATENT DOCUMENTS

| | | | |
|---|---|---|---|
| 708,716 | 9/1902 | Kennedy | 417/507 |
| 2,350,537 | 6/1944 | Scott | 417/295 |
| 2,961,147 | 11/1960 | Osterkamp | 417/295 |
| 2,988,263 | 6/1961 | Fogt | 417/298 |
| 3,175,754 | 3/1965 | Larsson | 417/298 |
| 3,260,444 | 7/1966 | Williams et al. | 417/295 |
| 3,351,271 | 11/1967 | Bellmer | 417/298 |
| 3,366,062 | 1/1968 | Kelsey | 417/395 |
| 3,490,683 | 1/1970 | Kocher | 417/298 |
| 3,578,883 | 5/1971 | Cheney | 417/295 |
| 3,671,147 | 6/1972 | Laucks et al. | 417/295 |
| 3,817,661 | 6/1974 | Ingalls | 417/312 |
| 4,059,368 | 11/1977 | McGahan et al. | 417/395 |
| 4,115,044 | 9/1978 | Gannaway | 417/564 |

FOREIGN PATENT DOCUMENTS

| | | | |
|---|---|---|---|
| 2545279 | 4/1977 | Fed. Rep. of Germany | 417/559 |
| 2739883 | 3/1979 | Fed. Rep. of Germany | 417/559 |
| 2739897 | 3/1979 | Fed. Rep. of Germany | 417/559 |

*Primary Examiner*—William L. Freeh

*Attorney, Agent, or Firm*—Albert L. Jeffers; John F. Hoffman

[57] ABSTRACT

A cylinder unloading mechanism for a multi-cylinder compressor including a block having a plurality of cylinders. Each cylinder is closed by a valve plate having suction and discharge ports communicating with the cylinder and respectively having spring-biased suction and discharge valves. A cylinder head is secured to the valve plate and has suction and discharge chambers respectively communicating with the suction and discharge ports. Suction and discharge passages respectively communicate with the suction and discharge chambers in the head. A partition in the head divides the suction chamber into first and second sections respectively communicating with the suction port and suction passage, the partition having an unloading port communicating with the two sections of the suction chamber. A valve selectively opens and closes the unloading port and is actuated by a double-acting fluid power cylinder mounted on the head, the cylinder having fluid pressure lines adapted to be connected to an external source of fluid under pressure.

9 Claims, 6 Drawing Figures

CYLINDER UNLOADING MECHANISM FOR REFRIGERATION COMPRESSOR

BACKGROUND OF THE INVENTION

1. Field of the Invention

This invention relates generally to refrigeration compressors, and more particularly to an unloading mechanism for refrigeration compressors, especially multi-cylinder compressors.

2. Description of the Prior Art

It has been common practice to provide means for unloading a multi-cylinder refrigeration compressor in order to avoid starting the compressor under load, and further to control the refrigeration capacity in response to the cooling demand. Prior compressor unloading mechanisms known to the present applicants have generally fallen into two different categories. In the first category, means are provided for holding the suction valves open so that the refrigerant is drawn into a cylinder and then immediately discharged therefrom through the suction valve rather than being compressed and discharged through the discharge valve; U.S. Pat. No. 3,144,982 shows an unloading mechanism typical of the first category. In the second category, means is provided for blocking the suction passage so that no refrigerant is drawn into the cylinder; U.S. Pat. No. 3,578,883 shows an unloading mechanism typical of the second category. Prior unloading mechanisms in both categories known to the present applicants have been characterized by appreciable complexity and thus expense and it is therefore desirable to provide a simple unloading mechanism in the second or blocking category which is readily controlled by a signal external to the compressor.

SUMMARY OF THE INVENTION

The present invention, in its broader aspects, provides unloading mechanism for a refrigeration compressor which comprises a body having a compression chamber therein, the body having valved suction and discharge ports therein communicating with the compression chamber. Means are provided for defining suction and discharge chambers respectively communicating with the suction and discharge ports, and suction and discharge passages respectively communicating with the suction and discharge chambers. The unloading mechanism of the invention comprises means for dividing the suction chamber into a first section having the suction port communicating therewith and a second section having the discharge port communication therewith, the dividing means having an unloading port therein communicating with the two sections. Unloading valve means is provided for selectively opening and closing the unloading port, and means are provided for actuating the valve means in response to a signal external to the compressor.

It is accordingly an object of the invention to provide an improved unloading mechanism for a refrigeration compressor.

Another object of the invention is to provide an improved unloading mechanism of a blocking type for a refrigeration compressor.

A further object of the invention is to provide an improved unloading mechanism of the blocking type for a multi-cylinder refrigeration compressor.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
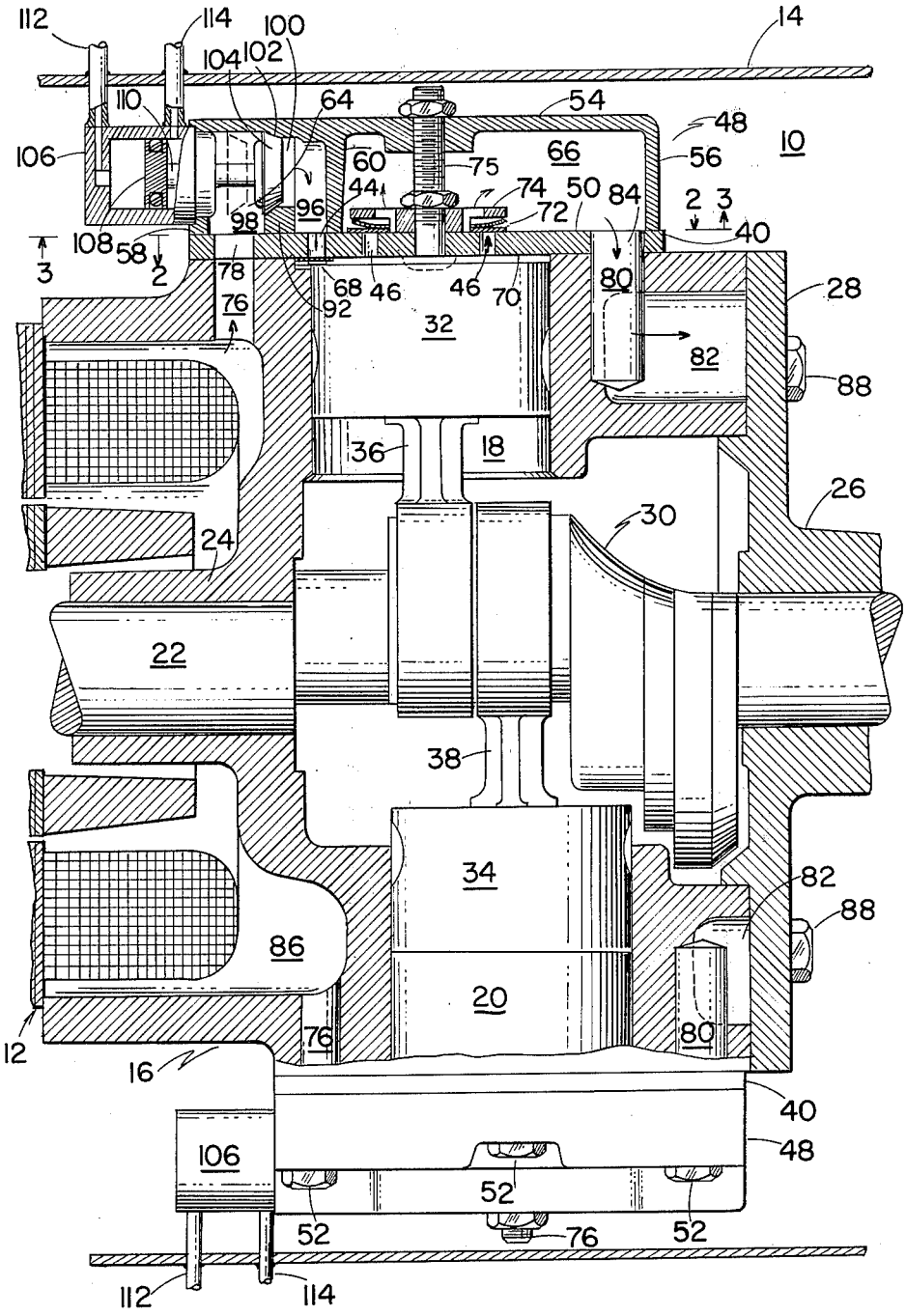
FIG. 1 is a side, cross-sectional view showing two-cylinder hermetic refrigeration compressor incorporating the improved unloading mechanism of the invention.
Figure 2:
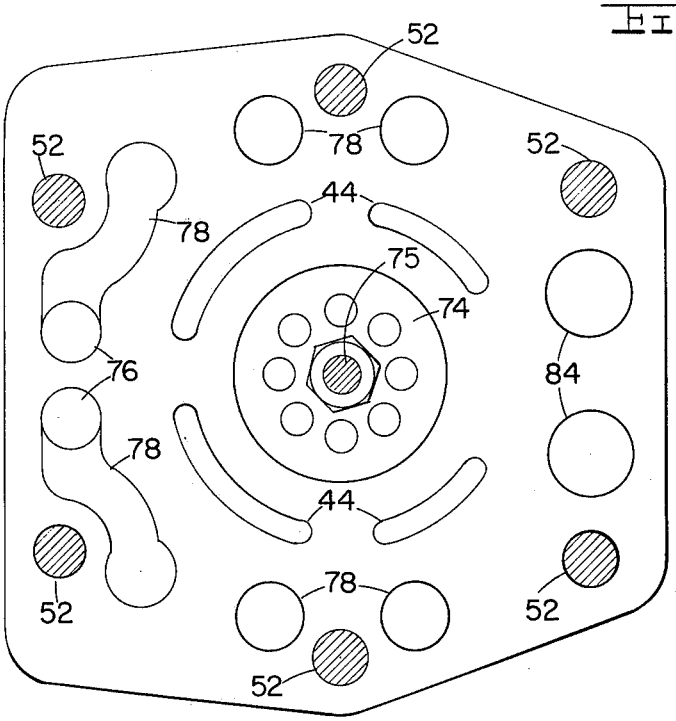
FIG. 2 is a cross-sectional view taken generally along the line 2—2 of FIG. 1.
Figure 3:
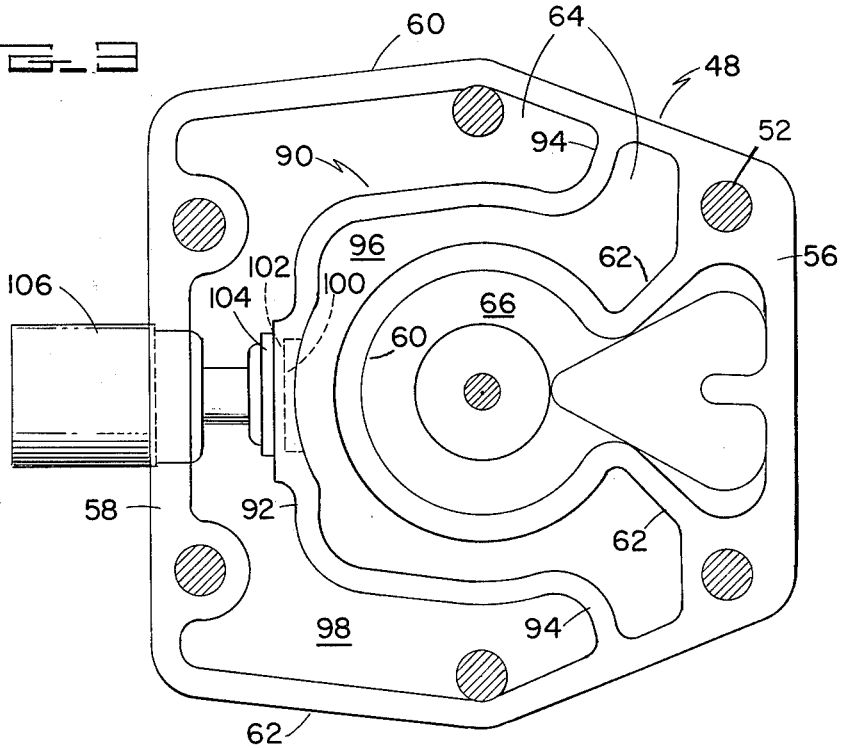
FIG. 3 is a cross-sectional view taken generally along the line 3—3 of FIG. 1.

Referring now to FIGS. 1, 2 and 3 of the drawings, a typical hermetic refrigeration compressor is shown, generally indicated at 10, driven by motor 12 and housed within outer, hermetically sealed casing 14. Compressor 10 comprises cast block 16 having cylinders 18, 20 formed therein; while two cylinders 18, 20 have been shown, it will be readily understood that additional cylinders may be provided.

Compressor drive shaft 22 is journalled in suitable bearings 24, 26 on block 16 and end shield 28, respectively, and has crank 30 thereon. Crank 30 is coupled to pistons 32, 34 in cylinders 18, 20 by connecting rods 36, 38.

Cylinders 18, 20 are closed by valve plates 40 having suction ports 44 and discharge ports 46 therein respectively communicating with cylinders 18, 20. Cylinder heads 48 are provided abutting upper sides 50 of valve plates 40, cylinder heads 48 and valve plates 40 being secured to block 16 by conventional bolts 52. In the illustrated embodiment, cylinder heads 48 have top wall 54, opposite end walls 56, 58 and opposite side walls 60, 62. Partition 60 extends from top wall 54 of cylinder head 48 to top surface 50 of valve plate 48 and has ends 62 joined to end wall 56 (FIG. 3). Partition 60 between ends 62 is generally circular in plane view (FIG. 3) and defines suction chamber 64 communicating with suction ports 44 and discharge chamber 66 communicating with discharge ports 46. Suction ports 44 have conventional leaf spring-biased suction valves 68 positioned by the crankcase to the bottom surface 70 of valve plate 40, and discharge ports 46 have conventional spring-biased discharge valve ring 72 retained on top surface 50 of valve plate 40 by spring retaining member 74 secured to valve plate 40 by suitable threaded fastener 75.

Block 16 has suction passages 76 formed therein communicating with suction chamber 64 in head 48 through suction openings 78 in valve plate 40. Block 16 also has discharge passages 80 therein communicating with discharge manifold 82 closed by end flange 28 and communicating with discharge chamber 66 in head 48 through discharge openings 84 in valve plate 40. It will be readily understood that the refrigerant from the evaporator of the refrigeration system is supplied to manifold 86, with which suction passages 76 communicate, by a conventional condensed refrigerant line (not shown), and that the compressed refrigerant is supplied from manifold 82 to the refrigeration system by another suitable refrigerant line (also not shown). End flange 28 is secured to block 16 by suitable threaded fasteners 88.

The compressor described above is conventional and does not form a part of our present invention.

In accordance with the invention, another partition 90 is provided in cylinder head 48 extending from top wall 54 to top surface 50 of valve plate 40. Partition 90 conforms generally to partition 60, being generally U-shaped with its bight portion 92 extending toward but being spaced from end wall 58 and its ends 94 joined to side walls 60, 62 of cylinder head 48, partition 90 thus dividing suction chamber 64 into a first section 96 communicating with suction ports 44 and a second section 98 communicating with suction passages 76, 78.

Bight portion 92 of partition 90 has unloading port 100 formed therethrough communicating between sections 96, 98 of suction chamber 64. Unloading port 100 has valve seat 102 formed therein facing end wall 58 of cylinder head 48. Unloading port 100 is selectively opened and closed by unloading valve 104 actuated between its closed position seated on valve seat 102 and closing unloading port 100, as shown in solid lines in FIGS. 1 and 3, and an open position, as shown in dashed lines in FIG. 1, by double-acting fluid power cylinder 106 mounted on end wall 58 of cylinder head 48. Cylinder 106 has piston 108 therein with its piston rod 110 connected to valve 104. Suitable fluid pressure lines 112, 114 are coupled to the opposite ends of cylinder 106, extend outwardly through casing 14, and are adapted to be selectively coupled to a suitable source of fluid under pressure.

It will now be seen that with fluid power cylinder 106 actuated so as to close unloading valve 104, communication between suction ports 44 and suction manifold 86 is blocked thereby unloading cylinder 18 whereas, with cylinder 106 actuated to open valve 104, normal suction communication and compressor operation is provided. It will be readily understood that each cylinder of the compressor may be provided with the unloading mechanism described above.

Figure 4:
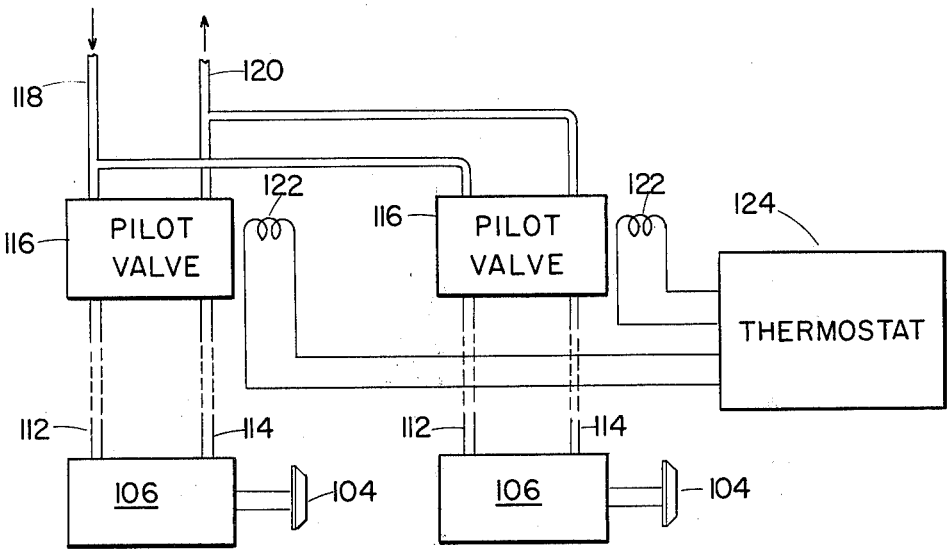
FIG. 4 schematically illustrates a control system for the unloading mechanism of FIG. 1.

Referring now to FIG. 4, fluid pressure lines 112, 114 connected to each fluid power cylinder 106 may be coupled to conventional solenoid-actuated pilot valves 116 respectively having fluid pressure line 118 and fluid discharge line 120 coupled thereto. Pilot valves 116 may have their solenoid coils 122 coupled for sequential energization by suitable thermostat device 124 which responds to the ambient temperature in the space being cooled. It will be readily understood that pilot valves 116 may be actuated in the desired sequence in response to other signals external to the compressor.

Figure 5:
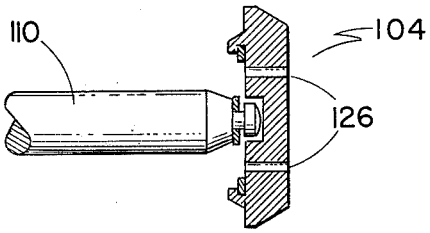
FIG. 5 is a fragmentary view, partly in cross-section, showing a modification of the invention.

Referring now to FIG. 5 in which like elements are indicated by like reference numerals, unloading valve 104 may be provided with orifices 126 for bleeding a small amount of refrigerant therethrough in the closed position of the valve thereby to cool the associated cylinder.

Figure 6:
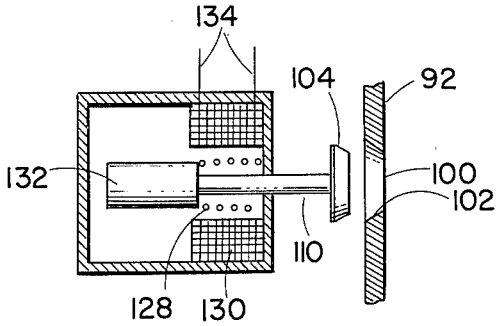
FIG. 6 is a fragmentary, cross-sectional view showing another modification.

Referring now to FIG. 6 in which like elements are again indicated by like reference numerals, it will be readily understood that unloading valves 104 may be actuated by a suitable solenoid rather than by the double-acting fluid power cylinder illustrated in previous figures and described above. Here, valve 104 is actuated to its open position by coil spring 128, and is actuated to its closed position by suitable solenoid coil 130 acting on armature 132 on actuating rod 110 of valve 104. Leads 134 coupled to coil 130 extend out of casing 14 and may be energized in a desired sequence thereby to energize coils 138 and close valves 104 in response to external signals, such as from thermostat 124.

As a further modification, piston 108 (FIG. 1) could be single acting with a return spring (not shown) for holding it in one position until actuated by fluid pressure.

While there have been described above the principles of this invention in connection with specific apparatus, it is to be clearly understood that this description is made only by way of example and not as a limitation to the scope of the invention.

What is claimed is:

1. In a hermetic refrigeration compressor comprising: a hermetically sealed outer housing, a block in said housing and having at least one cylinder therein, a reciprocably movable piston in each cylinder, means including a cylinder head in said housing for closing an end of said cylinder and having suction and discharge ports therein communicating with said cylinder, said cylinder head having suction and discharge chambers therein respectively communicating with said suction and discharge ports, an access opening in said head, said closing means having suction and discharge passages respectively communicating with said suction and discharge chambers, spring biased suction valve means for normally closing said suction port and being opened in response to a suction stroke of said piston, and spring biased discharge valve means for normally closing said discharge port and being opened in response to a discharge stroke of said piston, a cylinder unloading mechanism comprising: a partition in said cylinder head extending across said suction chamber between said suction passage and suction port and dividing said suction chamber into first and second sections, said partition having an unloading port therein communicating with said first and second suction chamber sections; an unloading valve having a closed position closing said unloading port thereby blocking communication between said suction chamber sections to unload said cylinder, and an open position permitting communication between said sections; and means for actuating said unloading valve between said closed and open positions in response to a control signal, said means for actuating said unloading valve comprising: a double acting springless return fluid motor connected to said access opening in the head and comprising a plunger cylinder connected to said access opening having a double acting plunger therein, said plunger extending through the access opening and being connected to said valve, said plunger dividing the plunger cylinder into two chambers, and a selectively actuatable pilot valve means connected to said plunger cylinder chambers for alternatively connecting said plunger cylinder chambers to a source of fluid pressure, whereby the unloading valve is opened and closed in accordance with the state of said pilot valve.

2. The compressor of claim 1 wherein said closing means includes a valve plate closing said cylinder end and having said suction and discharge ports therein, said cylinder head engaging said valve plate and having side and top walls, said top wall having said partition extending therefrom to said valve plate, said top wall having another partition extending therefrom to said valve plate and defining said suction and discharge chambers, said plunger cylinder means being mounted on said side wall.

3. The compressor of claim 1 including a pair of fluid conduits connected respectively to said plunger cylinder chambers and to said pilot valve.

4. The compressor of claim 1 wherein there are a plurality of said cylinders in said block each having a said cylinder head, and including a plurality of independently said cylinder unloading mechanisms respectively in each of said heads.

5. The compressor of claim 4 further comprising means for sensing a condition responsive to the operation of said compressor, and means for sequentially operating said actuating means in response to said sensing means.

6. In a refrigeration compressor comprising a block having at least one cylinder therein, a reciprocally movable piston in each cylinder, means including a cylinder head for closing an end of said cylinder and having suction and discharge ports therein communicating with said cylinder, said cylinder head having suction and discharge chambers therein respectively communicating with said suction and discharge ports, said closing means having suction and discharge passages respectively communicating with said suction and discharge chambers, spring-biased suction valve means for normally closing said suction port and being opened in response to a suction stroke of said piston, and spring-biased discharge valve means for normally closing said discharge port and being opened in response to a discharge stroke of said piston, a cylinder unloading mechanism comprising: a partition in said cylinder head extending across said suction chamber between said suction passage and suction port and dividing said suction chamber into first and second sections, said partition having an unloading port therein communicating with said first and second suction chamber sections; an unloading valve having a closed position closing said unloading port thereby blocking communication between said suction chamber sections to unload said cylinder, and an open position permitting communication between said sections; and means for actuating said unloading valve between said closed and open positions in response to a control signal, said closing means including a valve plate closing said cylinder end and having said suction and discharge ports therein, said cylinder head engaging said valve plate and having side and top walls, said top wall having said partition extending thereform to said valve plate, said top wall having another partition extending therefrom to said valve plate and defining said suction and discharge chambers, said actuating means being mounted on said side wall, said cylinder head side wall including opposite side and end sections, said first-named portion extending between said side sections and being generally U-shaped with its bight portion extending toward but spaced from said one end section, said unloading ports being formed in said bight portion, and said actuating means being mounted on the exterior of said one end section.

7. The compressor of claim 6 wherein said other partition conforms generally to said first-named portion and is spaced therefrom said other partition having opposite ends extending from the other said end section.

8. The compressor of claim 6 wherein said unloading port includes a valve seat for said unloading valve.

9. In a refrigeration compressor comprising a block having at least one cylinder therein, a reciprocally movable piston in each cylinder, means including a cylinder head for closing an end of said cylinder and having suction and discharge ports therein communicating with said cylinder, said cylinder head having suction and discharge chambers therein respectively communicating with said suction and discharge ports, said closing means having suction and discharge passages respectively communicating with said suction and discharge chambers, spring-biased suction valve means for normally closing said suction port and being opened in response to a suction stroke of said piston, and spring-biased discharge valve means for normally closing said discharge port and being opened in response to a discharge stroke of said piston, a cylinder unloading mechanism comprising: a partition in said cylinder head extending across said suction chamber between said suction passage and suction port and dividing said suction chamber into first and second sections, said partition having an unloading port therein communicating with said first and second suction chamber sections; an unloading valve having a closed position closing said unloading port thereby blocking communication between said suction chamber sections to unload said cylinder, and an open position permitting communication between said sections; and means for actuating said unloading valve between said closed and open positions in response to a control signal, said unloading valve having at least one bleed orifice therein for bleeding refrigerant therethrough into said cylinder in said closed position thereby to cool said cylinder when unloaded.

* * * * *